United States Patent [19]

Hanyu

[11] Patent Number: 4,560,296

[45] Date of Patent: Dec. 24, 1985

[54] COLOR PRINTER

[75] Inventor: Susumu Hanyu, Tokyo, Japan

[73] Assignee: Janome Sewing Machine Co., Ltd., Tokyo, Japan

[21] Appl. No.: 616,434

[22] Filed: May 31, 1984

[30] Foreign Application Priority Data

Jun. 10, 1983 [JP] Japan ..... 58-102728

[51] Int. Cl.[4] ..... B41J 11/02

[52] U.S. Cl. ..... 400/649; 400/662; 400/655

[58] Field of Search ..... 400/662, 649, 470, 471, 400/471.1, 652, 654, 655, 648, 659, 554, 188

[56] References Cited

U.S. PATENT DOCUMENTS

| | | | |
|---|---|---|---|
| 2,403,296 | 7/1946 | Needham et al. | 400/655 |
| 2,605,881 | 8/1952 | Tholstrup | 400/654 X |
| 4,210,917 | 7/1980 | Lane III | 400/470 X |
| 4,386,861 | 6/1983 | Kurihara | 400/470 X |

*Primary Examiner*—Edgar S. Burr

*Assistant Examiner*—Charles A. Pearson

*Attorney, Agent, or Firm*—Michael J. Striker

[57] ABSTRACT

A color printer, including a guide shaft, a printing head slidably mounted on the guide shaft; a control shaft having a center axis and being parallel to the guide shaft, and a platen slidably mounted on the control shaft so as to be arranged opposite to the printing head, and having a central axis oriented vertically to the control shaft and the guide shaft, and being turnable in a plane vertical to the control shaft, and rotatable around the vertically oriented central axis, the platen also having a plurality of layers respectively containing ink of different color, the layers being adjacently and coaxially arranged on the central axis of the platen so as to form an outer working surface, the outer working surface being oriented in a plane defined by a circular arc having a predetermined radius centered at the center axis of the control shaft so that any one selected layer of the plurality of layers is positionable to directly confront the printing head with a constant predetermined spacing therebetween.

5 Claims, 4 Drawing Figures

COLOR PRINTER

FIELD OF THE INVENTION

This invention relates to a color printer, in which a platen is shaped as a barrel and is rotated by itself in a circular arc, and especially in which colors are changed easily and rapidly.

SUMMARY OF THE INVENTION

With respect to objects of the invention, first is that colors of a platen are changed by rotation control transverse to a moving direction of the platen, and a printing machine may be made small in size in a printing direction.

Second is that when the platen is moved in synchronism with a printing head, the platen is rotated by itself around a platen shaft, thereby avoiding continuous use of the platen on the same part of an object, so that lowering of printing operation is prevented as well as increasing the life of the platen.

Third is that since the platen is shaped as a barrel, an ink containing body of the platen contacts a printing paper fed only at a part of said body toward a pointed end of the printing head, so that the paper is not stained with ink.

Fourth is that a structure is made in that the platen shaft is transverse to the moving direction of the platen and is overhung, and when the platen is repaired, it is easy to exchange members.

DETAILED DESCRIPTION OF THE INVENTION

Figure 1:
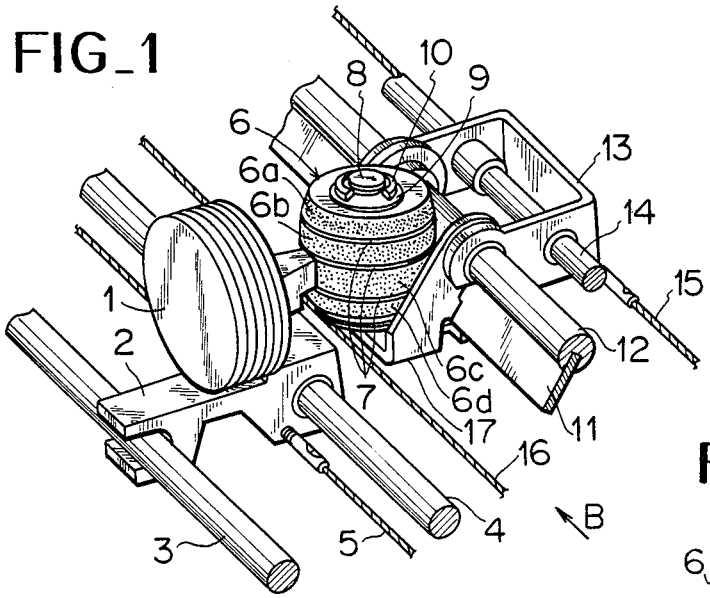
FIG. 1 is a perspective view of main parts of a printer according to the invention.

The present invention will be explained in reference to an embodiment shown in the accompanied drawing. In FIG. 1, a printing head 1 is provided on a carriage 2 which is slidable and moved on guide shafts 3 and 4 by means of a motor (not shown) or the like via a wire 5.

A platen 6 which will be referred to in detail comprises bodies 6*a*, 6*b*, 6*c*, 6*d* containing inks of different colors respectively, and is moved in synchronism with the printing head 1, while rotating by itself in accompaniment with said movement, so that printing is made by inking a printing paper (not shown) on its side toward the platen fed between a pointed end of the printing head 1 and the platen 6.

The platen 6 is shaped as a barrel by laminating a plurality of ring like bodies 6*a*, 6*b*, 6*c*, 6*d* containing different colored inks respectively via partitions 7. In the present embodiment, the body 6*c* containing the black ink is larger in width than others, since it is most used.

Figure 2:
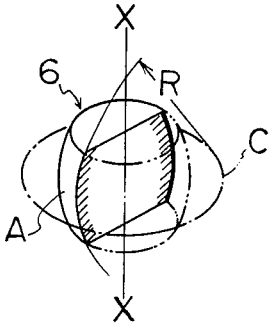
FIG. 2 is a view for explaining a shape of a platen.

Further, as seen in FIG. 2, the platen 6 is barrel-shaped and has an outer face A around a vertical center axis X—X and in a plane defined by a circular arc which may be drawn by a predetermined radius R, the center of the circular arc being in the locus defining a circle C. The platen 6 is arranged opposite to the printing head 1 in a condition where the circle C is in contact with the center axis of a control shaft 12, so that the outer face A of the platen 6 just confronting the printing head 1 may be located substantially in the plane defined by the circular arc which may be drawn by the radius R extended from the center axis of the control shaft 12, and so that a space will always be kept constant between the printing head 1 and the outer face of each ring-like body of the platen 6 coming to directly confront the printing head 1. The platen 6 is rotatably mounted on a platen shaft 8 which is implanted on a supporter 17 and is thrust-stopped by a washer 9 and a stopper ring 10.

The supporter 17 is not rotatable on the control shaft 12 which has a key 11, but is slidable thereon.

A drive body 13 is slidably mounted on the control shaft 12 and a guide shaft 14, and holds the supporter 17 at its both sides on the control shaft 12, and is moved with the supporter 17 along said shafts 12 and 14 via a wire 15.

The colors of the platen 6 are changed by rotation control of the control shaft 12 in the present embodiment. Since the platen 6 is, as said above, shaped as a barrel and a body portion has a certain radius in a cross section including a certain axis X—X (coinciding with the axis of the platen shaft), and if the platen is furnished in a relative position where said circle C meets the axis of the control shaft 12 (FIG. 2), a distance between the surface of the platen 6 and the pointed end of the printing head 1 is kept constant, irrespectively of changing the colors.

The platen 6 is defined with a pulley portion 6*e* at its lower part, on which a wire 16 is wound. The wire is secured at its both ends to a couple of members (not shown) which are rotated together with the control shaft 12 while changing the color, and said wire is effected with a certain tension, irrespectively of changing the colors. The platen 6 is rotated by itself when the printing is made in that the platen 6 is moved in synchronism with the printing head.

In the present embodiment, the supporter 17 is laterally moved via the drive body 13, but it may be directly moved, where said drive body 13 is not required.

The control shaft 12 of this embodiment is provided with a key 11 for transmitting rotation control while changing the color, but it may be provided with a member square or hexagonal in cross section therefor.

Actuation of the embodiment of the invention will next be explained. The printing is made in that the head 1 and the platen 6 are moved in synchronism with each other, and they are controlled by a single motor and positioning is enough once. Since platen 6 is rotated around the platen shaft 8 via the wire 16, its part facing the printing head 1 via the paper is renewed, so that successive use on one part is avoided, and the printing is prevented from lowering the operation, and the life of the platen may be elongated as well.

Since the platen 6 is barrel-shaped, one of the ink containing bodies 6*a*, 6*b*, 6*c*, 6*d* of the platen 6 contacts the paper fed in only at a part of the body toward the pointed end of the printing head 1, and the paper is not stained with ink.

Figure 3:
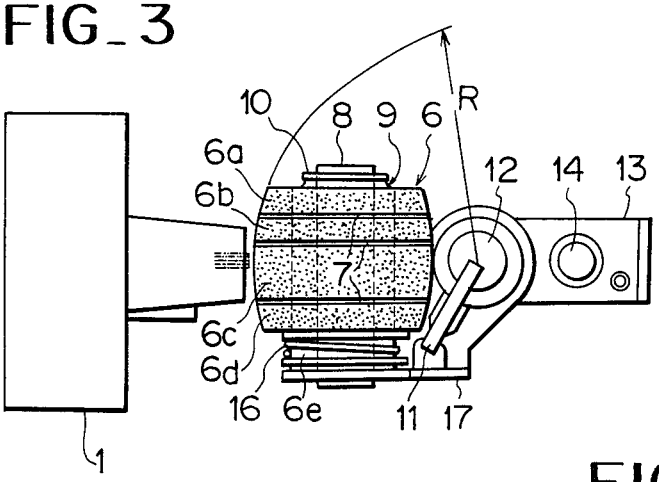
FIGS. 3 and 4 are views seen from an arrow B in FIG. 1, showing changing of a color.
Figure 4:
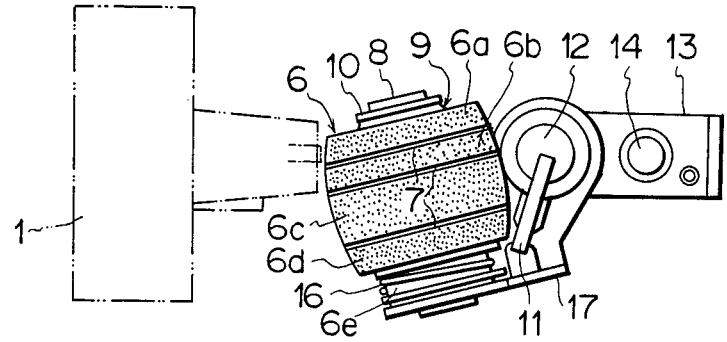

The color is changed by rotating the control shaft 12 having a key 11. FIG. 3 shows a condition of selecting the body 6*c*, and FIG. 4 shows a condition of selecting the body 6*a*.

Since the platen and the control shaft are in the relative position that the circle A and the axis of the control shaft 12 are met with each other, the distance between the ink containing body 6 and the pointed end of the printing head 1 is always constant, irrespectively of changing the colors.

Changing the color is made by rotation control transverse to the moving direction of the platen 6. This rotation control may be provided by switching to a clutch from a motor which laterally moves the head 1 and the platen 6. An available moving range of the platen may be made large to the left and the right, so that the machine may be made small in size in the printing direction accordingly.

The platen shaft 8 is transverse to the moving direction of the platen 6 and is of an overhung structure, a lower end of which is secured to the supporter 17. When repairing, the platen 6 is taken off of the platen shaft 8 by removing the stopper ring 10 and the washer 9.

According to the present invention, the under mentioned merits may be brought about. First is that the colors of the platen are changed by rotation control transverse to the moving direction of the platen, and the printing machine may be made small in size in the printing direction.

Second is that when the platen is moved in synchronism with the printing head, the platen is rotated by itself around the platen shaft thereby avoiding continuous use of the platen on the same part of the ink containing body, so that lowering of printing operation is prevented and life of the platen is elongated.

Third is that since the platen is barrel-shaped, an ink containing body of the platen contacts a printing paper only at a part of said body toward the pointed end of the printing head, so that the paper is not stained with ink.

Fourth is that a structure is made so that the platen shaft is transverse to the moving direction of the platen and is overhung, so that when the platen is repaired, it is easy to exchange members.

I claim:

1. A color printer, comprising: a guide shaft; a printing head slidably mounted on said guide shaft; a control shaft having a center axis and being parallel to said guide shaft, a platen slidably mounted on said control shaft so as to be arranged opposite to said printing head and having a central axis oriented in a plane normal to said control shaft and said guide shaft, said platen being formed as a body of revolution with a generally circular cross section taken in a plane normal to said central axis, said platen being turnable in said plane and rotatable around said central axis, said platen also having a plurality of layers respectively containing ink of different color, said layers being adjacently and coaxially arranged on said central axis of said platen so as to form an outer working surface, said outer working surface being defined by a circular arc having a predetermined radius centered at said center axis of said control shaft so that any one selected layer of said plurality of layers is positionable to directly confront said printing head with a constant predetermined spacing therebetween; and means for carrying said platen and being turnable so that different layers of said platen confront said printing head.

2. A color printer as defined in claim 1, wherein said control shaft is pivotable around said center axis thereof said platen carrying means being formed so that said platen is rotatable around said vertically oriented central axis, said platen carrying means being slidably mounted on said control shaft and being turnable by said pivoting of said control shaft so that different layers of said platen confront said printing head.

3. A color printer as defined in claim 1; and further comprising a plurality of partitions for separating said plurality of layers of said platen.

4. A color printer as defined in claim 1, wherein each said layor of said plurality of layers has a width, and one of said layers has a width greater than the width of the other layers.

5. A color printer as defined in claim 2; and further comprising a key fixed to said control shaft for turning said platen carrying means.

* * * * *